US005363825A

United States Patent [19]

Becker

[11] Patent Number: 5,363,825

[45] Date of Patent: Nov. 15, 1994

[54] FUEL INJECTION ARRANGEMENT FOR AN INTERNAL COMBUSTION ENGINE HAVING A PLURALITY OF ELECTRIC FUEL INJECTION VALVES

[75] Inventor: Norbert Becker, Gifhorn, Germany

[73] Assignee: Volkswagen AG, Wolfsburg

[21] Appl. No.: 166,551

[22] Filed: Dec. 14, 1993

[30] Foreign Application Priority Data

Jan. 27, 1993 [DE] Germany ..... 4302186

[51] Int. Cl.[5] ..... F02M 61/14

[52] U.S. Cl. ..... 123/456; 123/470

[58] Field of Search ..... 123/456, 468, 469, 470, 123/472

[56] References Cited

U.S. PATENT DOCUMENTS

| | | | |
|---|---|---|---|
| 4,991,557 | 2/1991 | DeGrace et al. | 123/470 |
| 5,046,469 | 9/1991 | Gmelin | 123/469 |
| 5,129,834 | 7/1992 | Cranford | 123/456 |
| 5,131,857 | 7/1992 | Gmelin et al. | 123/456 |
| 5,203,304 | 4/1993 | Hafner et al. | 123/456 |
| 5,209,204 | 5/1993 | Bodenhausen et al. | 123/456 |
| 5,226,391 | 7/1993 | Gras et al. | 123/456 |
| 5,295,467 | 3/1994 | Hafner | 123/456 |

FOREIGN PATENT DOCUMENTS 4002393 8/1991 Germany .

*Primary Examiner*—E. Rollins Cross
*Assistant Examiner*—Thomas N. Moulis
*Attorney, Agent, or Firm*—Brumbaugh, Graves, Donohue & Raymond

[57] ABSTRACT

A hydraulic coupling and an electrical plug connection supply an electric fuel injection valve with fuel and electric power through a distributor rail associated with a plurality of injection valves. The parts of all of the couplings and plug connections for the injection valves connected to the distributor rail extend in parallel directions to that a single relative motion between the distributor rail and the valves is sufficient to make all the connections. To facilitate repair, the distributor rail components of the plug connections are individually detachably mounted in the distributor rail under a common removable cover.

3 Claims, 2 Drawing Sheets

FUEL INJECTION ARRANGEMENT FOR AN INTERNAL COMBUSTION ENGINE HAVING A PLURALITY OF ELECTRIC FUEL INJECTION VALVES

BACKGROUND OF THE INVENTION

This invention relates to arrangements for supplying fuel and electric power to a plurality of fuel injection valves in an internal combustion engine.

German Offenlegungsschrift No. 40 02 393 discloses an arrangement for supplying fuel and electric power to a plurality of fuel injection valves in which all of the hydraulic connections and all of the electrical connections can be made between a distributor rail and all of the injection valves associated with the distributor rail by a single assembly motion of the distributor rail. In contrast, the oblique orientation of conventional arrangements of the injection valve components of the electrical plug connections with respect to the longitudinal axes of the fuel injection valves, and hence also with respect to the alignment of the hydraulic couplings, requires a first assembly motion of the distributor rail for simultaneous connection of the hydraulic couplings and then, for each injection valve, an individual assembly operation to make the electrical plug connections.

During the operation of an internal combustion engine provided with this arrangement, relative vibrations occur between the individual injection valves and the distributor rail, which can, in the absence of special precautions, result in frictional motions between the distributor rail and the injection valve components of the electrical plug connections, and hence premature wear of the plug connections. To counteract this in the prior art arrangements, the distributor rail components of the electrical plug connections are supported on the distributor rail with play, so that they are able, together with the corresponding injection valve components of the plug connections, to move relative to the distributor rail.

In the above-mentioned prior art arrangements, the distributor rail components of all of the plug connections are permanent components of the distributor rail. Consequently, if only one of these components is damaged, the entire distributor rail including the distributor rail components of all of the plug connections must be replaced.

SUMMARY OF THE INVENTION

Accordingly, it is an object of the present invention to provide a fuel injection arrangement for an internal combustion engine having a plurality of fuel injection valves which overcomes the above-mentioned disadvantages of the prior art.

Another object of the invention is to provide such a fuel injection arrangement wherein the hydraulic connections and the electrical connections to the fuel injection valves are combined in an advantageous fashion and are protected from the environment while avoiding high repair expenses.

These and other objects of the invention are attained by providing a fuel injection arrangement including a common distributor rail for fuel and electrical power supply to a plurality of fuel injection valves wherein the distributor rail components of the fuel supply and electrical supply for each fuel valve are aligned in parallel connection directions and are mountable as a unit in the common distributor rail and including a movable cover for covering the components mounted in the distributor rail.

This fuel injection arrangement according to the invention is advantageous because conventional electrical plugs may be used as assemblies for the distributor rail components of the electrical plug connections for the fuel injection valves. In a preferred embodiment of the invention, the electrical plug assemblies can be inserted from the side of the distributor rail into corresponding mounting openings in the distributor rail. The above-mentioned risk of premature wear of the plug connections as a result of relative motions between plugs and bushings during operation of the internal combustion engine may be avoided in a simple manner by mounting the plug components in the corresponding distributor rail openings using resilient grommets of appropriate shape. These resilient grommets may be components of the corresponding electrical plug assemblies and may be designed so that they are provided with accommodating grooves for the edges of the corresponding mounting openings in the distributor rail.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figure 2:
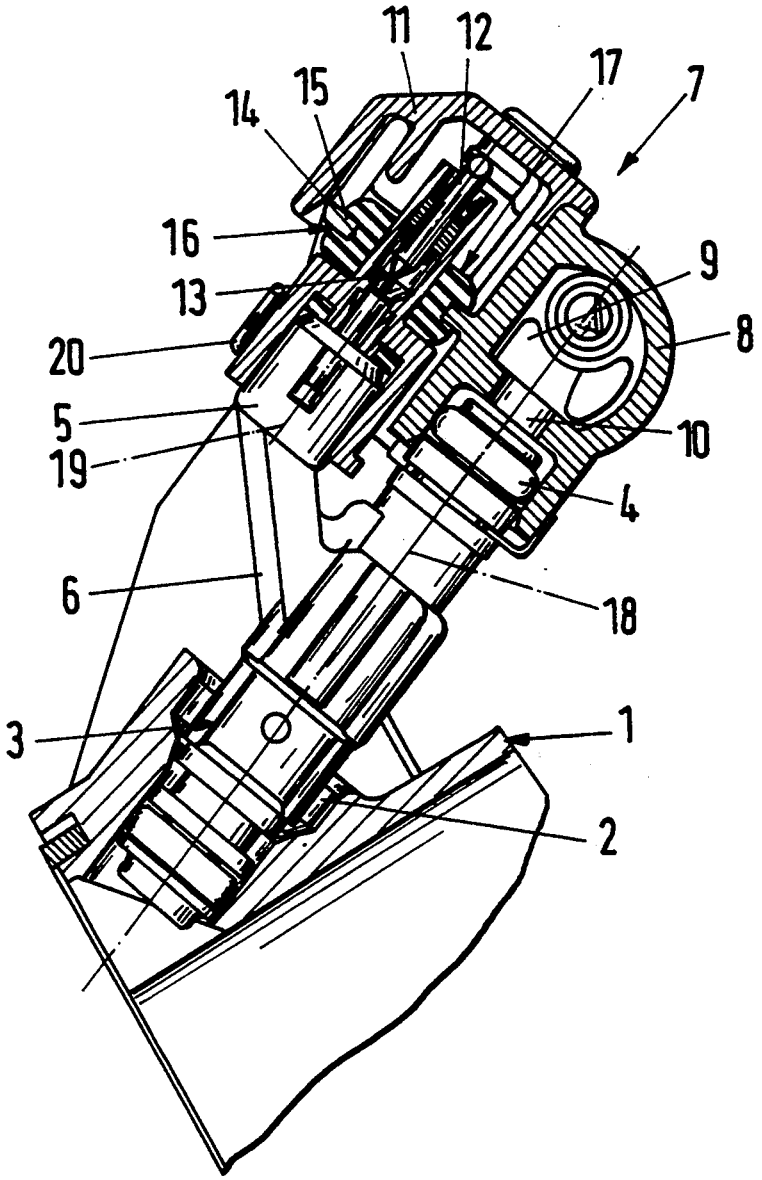
FIG. 2 is a cross-sectional view illustrating a fuel injection valve of the arrangement shown in FIG. 1 installed in an internal combustion engine.

Referring first to FIG. 2, the typical embodiment of the invention is shown therein in conjunction with a part of an intake pipe 1 of an internal combustion engine in which a mounting 2 for the nozzle end of an electromagnetic injection valve 3 opens downwardly into the cylinder head of the engine. The fuel injection valve itself is conventional and the structural details are not relevant to the present invention. Of interest in this case is the fact that, as shown in FIG. 2, the valve has an upper end region 4 supporting a valve component of a hydraulic coupling for supplying fuel to the valve and another upper end region 5, supported on an arm 6, in which a valve component of an electrical plug connection is mounted.

Figure 1:
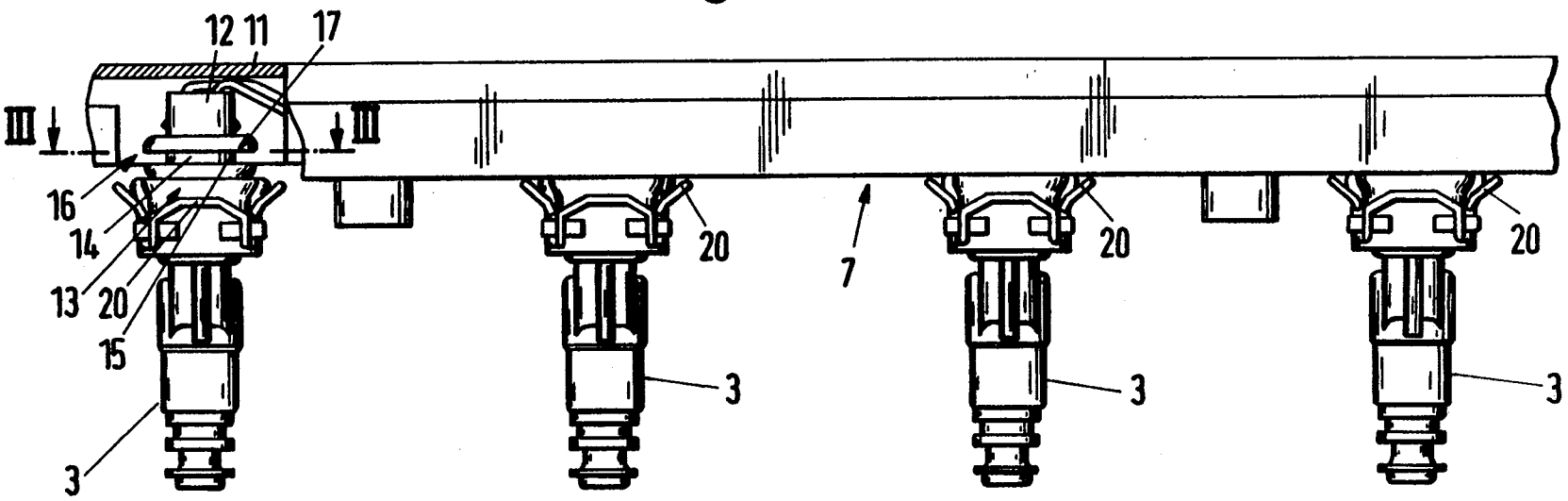
FIG. 1 is a side view, partly in section, illustrating a representative embodiment of a fuel injection arrangement in accordance with the invention.
Figure 3:
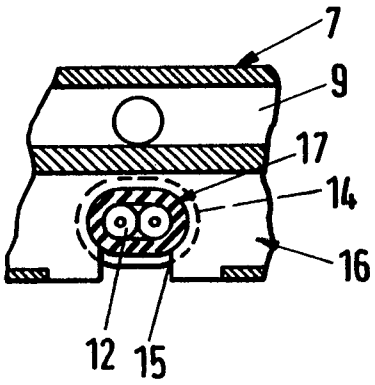
FIG. 3 is a fragmentary sectional view taken along the line III—III in FIG. 1.

A distributor rail 7, which has a fuel line 9 and a hydraulic coupling part 10 in a housing part 8, supplies the fuel as well as the electric power required by the operation of all of the injection valves 3 of the internal combustion engine, and a cover 11, which is detachably mounted on the housing part 8, covers the distributor rail components 12 of all of the electrical plug connection units 13, as shown in FIG. 1. Each component 12 is resiliently mounted on the distributor rail 7 by a resilient grommet 17 having an outer annular groove 14 received in the sides of an Ω-shaped opening 15 in the mounting plate 16, best seen in FIG. 3, which is open toward the left as viewed in FIG. 2. The grommet 17 engages the opening 15 so as to prevent the component 12 from slipping out during assembly. Thus, the distributor rail plug component 12 is supported in fixed engagement with the valve plug component in the end region 5 of the injection valve 3, but is resiliently supported on the distributor rail 7. In this way, the resilient grommets 17 avoid the need for close manufacturing tolerances of the plug components. At the same time, this mounting arrangement is, of course, made strong enough so that the electrical plug component 12 on the distributor rail can be engaged with the corresponding valve component 5 to permit the plug connection 13 to be completed.

As can be seen in FIG. 2, the longitudinal axes 18 and 19 of the fuel couplings 4 and the plug connections 13 are parallel so that all of the fuel couplings and electrical plug connections of valves in the fuel injection arrangement can be made by a single assembly operation in which the distributor rail 7 is moved in the direction parallel to those axes. Although engine vibrations and shocks are transmitted to the end regions 5 of the injection valves 3 and hence also to the valve components of the plug connections 13 when the engine is running, the distributor rail components 12 of the plug connections form a vibrational unit with the valve components of the plug connections 13 because they are supported resiliently on the distributor rail 7 by the resilient grommets 17, thereby avoiding relative motions between the two components of each plug connection and hence the undesirable wear on them.

To replace the individual components of a plug connection, the cover 11 is removed, the corresponding valve 3 is removed after loosening a conventional retaining clamp 20, and the distributor rail plug component 12 is pulled out of the opening 15 in which it is retained. A new plug component 12 is then coupled to the electrical power line in the distributor rail and the valve and inserted into the opening 15 of the distributor rail 7.

Although the invention has been described herein with reference to a specific embodiment, many modifications and variations therein will readily occur to those skilled in the art. Accordingly, all such variations and modifications are included within the intended scope of the invention.

I claim:

1. A fuel injection arrangement for an internal combustion engine comprising a plurality of electric fuel injection valves, a distributor rail for supplying fuel and electric power to the valves, a plurality of hydraulic couplings and a corresponding plurality of electrical plug connections, each having two component parts, associated with the distributor rail and with a valve, respectively, which are aligned for parallel engaging motions, the distributor rail components of the plug connections being individually detachable from the distributor rail, and a common cover for the distributor rail components movable to an open position with respect to the distributor rail components of the plug connections.

2. A fuel injection arrangement according to claim 1 including a mounting plate in the distributor rail having a plurality of Ω-shaped openings extending transversely to the direction of parallel engaging motions in which the distributor rail components of the plug connections are mounted.

3. A fuel injection arrangement according to claim 1 including a plurality of resilient grommets in which the distributor rail components of the plug connections are mounted, the grommets being inserted into openings in the distributor rail so that each pair of distributor rail and injection valve component parts forming a plug connection is vibrationally decoupled from the distributor rail.

* * * * *